US009415836B1

(12) United States Patent
Eekhoff et al.

(10) Patent No.: US 9,415,836 B1
(45) Date of Patent: Aug. 16, 2016

(54) HYBRID RUNNING SURFACE BOAT

(71) Applicant: Pontoon Boat LLC, Elkhart, IN (US)

(72) Inventors: Trent Allan Eekhoff, Grand Rapids, MI (US); Brad Roy Fishburn, Nappanee, IN (US); Jacob Steven Vogel, Granger, IN (US); Anthony Duane Williams, Maryville, TN (US)

(73) Assignee: Pontoon Boat LLC, Elkhart, IN (US)

( * ) Notice: Subject to any disclaimer, the term of this patent is extended or adjusted under 35 U.S.C. 154(b) by 44 days.

(21) Appl. No.: 14/520,711

(22) Filed: Oct. 22, 2014

Related U.S. Application Data

(60) Provisional application No. 61/895,643, filed on Oct. 25, 2013.

(51) Int. Cl.

| | |
|---|---|
| ***B63B 1/00*** | (2006.01) |
| ***B63B 1/12*** | (2006.01) |
| ***B63B 3/00*** | (2006.01) |
| ***B63B 3/48*** | (2006.01) |

(52) U.S. Cl.
CPC . *B63B 1/125* (2013.01); *B63B 3/00* (2013.01); *B63B 3/48* (2013.01)

(58) Field of Classification Search
CPC ..... B63B 1/125; B63B 3/00; B63B 3/48
See application file for complete search history.

(56) References Cited

U.S. PATENT DOCUMENTS

| | | | | |
|---|---|---|---|---|
| 3,002,484 | A | 10/1961 | Dube | |
| 3,115,860 | A | 12/1963 | Payne | |
| 3,230,918 | A | 1/1966 | Compton | |
| 3,401,663 | A | 9/1968 | Yost | |
| 3,702,106 | A | 11/1972 | Wilder | |
| 3,996,871 | A | 12/1976 | Boismard | |
| 4,348,972 | A | 9/1982 | Parsons | |
| 4,762,078 | A | 8/1988 | Palmer, Jr. | |
| 4,964,357 | A | 10/1990 | Genfan | |
| 5,184,564 | A | 2/1993 | Robbins et al. | |
| 6,000,355 | A | 12/1999 | Hall | |
| 6,016,762 | A | 1/2000 | Price | |
| 6,932,012 | B1 | 8/2005 | Philips et al. | |
| 6,988,456 | B1 | 1/2006 | Schooler | |
| 8,474,393 | B1 * | 7/2013 | Chandler | B63B 3/08 114/352 |
| 2002/0023579 | A1 * | 2/2002 | Profitt | B63B 1/125 114/61.12 |

* cited by examiner

*Primary Examiner* — Stephen Avila
(74) *Attorney, Agent, or Firm* — Faeagre Baker Daniels, LLP

(57) ABSTRACT

In one embodiment of the invention, a boat is provided which includes a deck; a plurality of pontoons extending in a direction parallel to a longitudinal axis of the deck, the deck being attached to the pontoons; and a hull portion attached to and extending from one of the pontoons. The hull portion extends outwardly to a distance wider than the pontoon to which it is attached, and the hull portion extends farther rearwardly than any of the pontoons.

16 Claims, 5 Drawing Sheets

HYBRID RUNNING SURFACE BOAT

This application claims priority from U.S. Provisional Patent application Ser. No. 61/895,643 filed on Oct. 25, 2013, the entirety of which is incorporated by reference as if fully rewritten herein.

BACKGROUND OF THE INVENTION

This invention relates to a hybrid running surface boat, and in particular to a boat having a combination of pontoons and a hull structure.

Boating has become an increasingly popular form of recreation, leisure and platform for water sports. One type of boat, namely, pontoon boats, which have two or more longitudinally extending flotation devices with buoyancy sufficient to float itself as well as a deck, seats, and other boat equipment attached thereto as well as passengers, have also seen a rise in popularity. Pontoon boats provide an economical way to provide a large deck area accommodating many passengers as well as a smooth ride. Pontoon boats are particularly suited for inland lakes and rivers that do not have large waves.

Pontoon boats have become increasingly more elaborate with many convenience features as well as increased power. Pontoon boats are now offered with sufficient engine capacity to pull one or more water skiers or wake board riders; however, the wake produced by a traditional pontoon boat lacks the distinct and high crest that is generated by single hull ski boats and desired by skiers and wake board riders, especially by those who are advanced in the sport.

Accordingly, it is an object of the present invention to provide a boat having a hybrid running surface, that is, one having a combination of pontoons and a hull profile to provide the smooth ride and large deck area of a pontoon boat, yet offering improved wake characteristics for skiing and wake boarding.

Prior art boats having hulls and/or pontoons include U.S. Pat. No. 4,762,078 to Palmer Jr. et al. (the '078 patent), the entirety of which is incorporated by reference herein, discloses an inflatable aquatic vessel having an in-board engine hull mated with a modified inflatable pontoon. The hull portion is designed as an in-board engine well without consideration of wake characteristics.

U.S. Pat. No. 4,348,972 to Parsons (the '972 patent), the entirety of which is incorporated by reference herein, discloses a multipurpose trimaran. The trimaran has a central hull and two side hulls.

U.S. Pat. No. 6,988,456 to Schooler (the '456 patent), the entirety of which is incorporated by reference herein, discloses a personal watercraft including a hull and at least two pontoons repositionally attached to the hull with at least one pontoon attached approximate the starboard side and at least one pontoon attached approximate the port side.

U.S. Pat. No. 6,932,012 to Philips et al. (the '012 patent), the entirety of which is incorporated by reference herein, discloses a multi-hull surface vessel with drag reduction on lateral hulls. The vessel includes a main hull and at least two lateral hulls disposed respectively on opposite sides of the main hull.

U.S. Pat. No. 6,016,762 to Price (the '762 patent), the entirety of which is incorporated by reference herein, discloses a planing foil for twin hull boats. Price discloses a standard pontoon boat having pontoons and a planing foil located toward the rear center underneath the deck to lift the boat and reduce drag.

U.S. Pat. No. 6,000,355 to Hall (the '355 patent), the entirety of which is incorporated by reference herein, discloses a watercraft having an elongated central V-type hull 60 and first and second stabilizers along the sides thereof. Each stabilizer includes an elongated flotation member having its longitudinal center aligned with the center of the hull. The stabilizers are retractably mounted on respective sides of the hulls with scissor arm type mounts.

U.S. Pat. No. 5,184,564 to Robbins et al. (the '564 patent), the entirety of which is incorporated by reference herein, discloses an inflatable tube or pontoon configured to fit around a personal watercraft, such as jet ski. The pontoon has a generally V-shaped configuration with a closed front end and an open back end for receiving the jet ski.

U.S. Pat. No. 4,964,357 to Genfan (the '356 patent), the entirety of which is incorporated by reference herein, discloses a planing boat having a tube-like hull, a hydrofoil fixed to the front portion of the tube-like hull and a pair of floats attached to the hull. The floats include pivoting wings. When the boat stops and at low speeds, the floats are in the water, and when the boat is at a high speed, the operator lifts the floats out of the water using the pivoting wings. At the highest speed an operator puts the wings parallel to the water surface and the ground effect is used.

U.S. Pat. No. 3,996,871 to Boismard (the '871 patent), the entirety of which is incorporated by reference herein, discloses a vessel with hydroplaning hulls. In one embodiment, the vessels include a central hull and side hulls. The side hulls are set forward of the central hull.

U.S. Pat. No. 3,702,106 to Wilder (the '016 patent), the entirety of which is incorporated by reference herein, discloses a watercraft construction including a main hull portion and outrigger portions that are pivotally connected to the main hull for pivoting thereabout.

U.S. Pat. No. 3,401,663 to Yost (the '663 patent), the entirety of which is incorporated by reference herein, discloses a catamaran boat having lateral hull members and a central spray shield extending between the lateral hull members.

U.S. Pat. No. 3,230,918 to Compton (the '918 patent), the entirety of which is incorporated by reference herein, discloses a catamaran boat having a central hull and pivoting floats including a starboard float and a port float.

U.S. Pat. No. 3,115,860 to Payne (the '860 patent), the entirety of which is incorporated by reference herein, discloses a skiff having a standard skiff hull configuration and pontoons along opposite sides thereof to cause the skiff to plane over water whether under its own power or being towed.

U.S. Pat. No. 3,002,484 to Dube (the '484 patent), the entirety of which is incorporated by reference herein, discloses a boat having a standard hull configuration and pivotally connected lateral pontoons that are pivotally mounted to the boat.

None of the prior art discloses a hybrid running surface including a plurality of pontoons and a combination pontoon and hull portion designed to provide a wave or good wake characteristics.

SUMMARY OF THE INVENTION

In one embodiment of the invention, a boat is provided which includes a deck; a plurality of pontoons extending in a direction parallel to a longitudinal axis of the deck, the deck being attached to the pontoons; and a hull portion attached to and extending from one of the pontoons. The hull portion extends outwardly to a distance wider than the pontoon to which it is attached, and the hull portion extends farther rearwardly than any of the pontoons.

A part of the hull portion may not extend as far downwardly from the deck as the pontoons. The hull portion may also not extend as far downwardly from the deck as the pontoon to which it is attached in the area of attachment.

There may be three pontoons including two outward pontoons and a middle pontoon, with the hull portion being attached to the middle pontoon. The rear ends of the outward pontoons can be curved or angled so that outer ends of the outward pontoons extend back farther from a front of the boat than along the inner sides. The hull portion may extend downwardly further from said deck at a rear end thereof than said pontoons.

In another embodiment of the invention, a boat is provided which includes a deck; a plurality of pontoons extending in a direction parallel to a longitudinal axis of the deck, the deck being attached to the pontoons; and a hull portion attached to and extending from one of the pontoons. The hull portion and the pontoons having a rigid construction and are manufactured from the same materials, and at least a portion of the hull extends to a different depth from the deck than the pontoon to which it is attached. The hull portion may extend outwardly to a distance wider than the pontoon to which it is attached, and may extend farther rearwardly than any of the pontoons.

A portion of the hull may not extend as far downwardly from the deck as the pontoons. There can be three pontoons that may include two outward pontoons and a middle pontoon, and the hull portion can be attached to the middle portion. The hull portion may extend downwardly farther from the deck at a rear end thereof than the pontoons. The pair of outward pontoons may have curved or angled aft ends so that outward portions of the pontoons extend back further from a front end of the boat than along inner sides of the outward pontoons.

In yet another embodiment of the invention, a boat is provided which includes a deck; a plurality of pontoons extending in a direction parallel to a longitudinal axis of the deck, the deck being attached to the pontoons; and a hull portion attached to and extending from one of the pontoons, wherein the hull portion has a varied width, being narrowest where attached to the pontoon and widest at an aft end thereof. The hull portion may extend farther rearwardly than any of the pontoons. A portion of the hull may extend downwardly to a different depth than the pontoon to which it is attached. There may be three pontoons that include two outward pontoons and a middle pontoon, and the hull portion may be attached to the middle pontoon. The rear ends of the outward pontoons can be curved or angled so that the outer ends of the outward pontoons extend back further from a front of the boat than along the inner sides of the outward pontoons. A rear end of the hull may extend outwardly beyond at least a portion of the outward pontoons.

BRIEF DESCRIPTION OF THE DRAWINGS

The above-mentioned and other features and objects of this invention and the manner of obtaining them will become more apparent and the invention itself will be better understood by reference to the following description of embodiments of the present invention taken in conjunction with the accompanying drawings, wherein.

Figure 1:
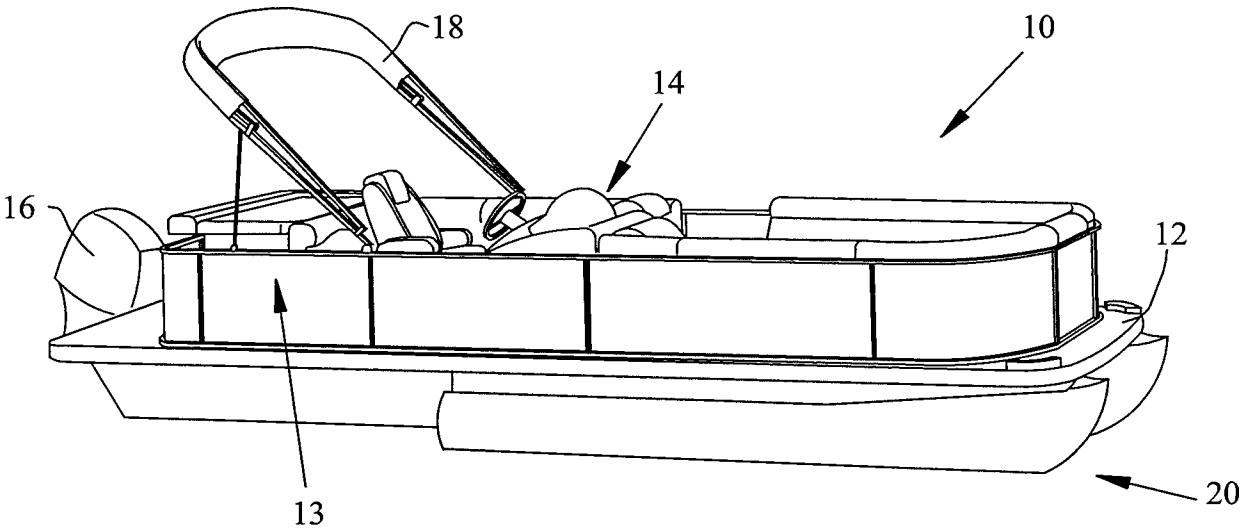
FIG. 1 is a perspective view of a first embodiment pontoon boat having a hybrid running surface in accordance with the subject invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, and such exemplifications are not to be construed as limiting the scope of the invention in any manner.

DETAILED DESCRIPTION OF EMBODIMENTS OF THE INVENTION

For the purposes of promoting an understanding of the principles of the invention, reference will now be made to the embodiments illustrated in the drawings, which are described below. It will nevertheless be understood that no limitation of the scope of the invention is thereby intended. The invention includes any alterations and further modifications in the illustrated devices and described methods and further applications of the principles of the invention, which would normally occur to one skilled in the art to which the invention relates.

Now referring to FIG. 1, a pontoon boat is shown, generally indicated as 10. Pontoon boat 10 includes a deck 12; a railing 13 extending around the outer periphery of deck 12; a seating arrangement, generally indicated as 14; an outboard motor 16; and an adjustable canopy 18, all of which may be of a variety known to one skilled in the art. Pontoon boat 10 also includes a hybrid running system in accordance with the subject invention, generally indicated as 20, to provide flotation of boat 10 in water while either stationary or in motion.

Figure 2:
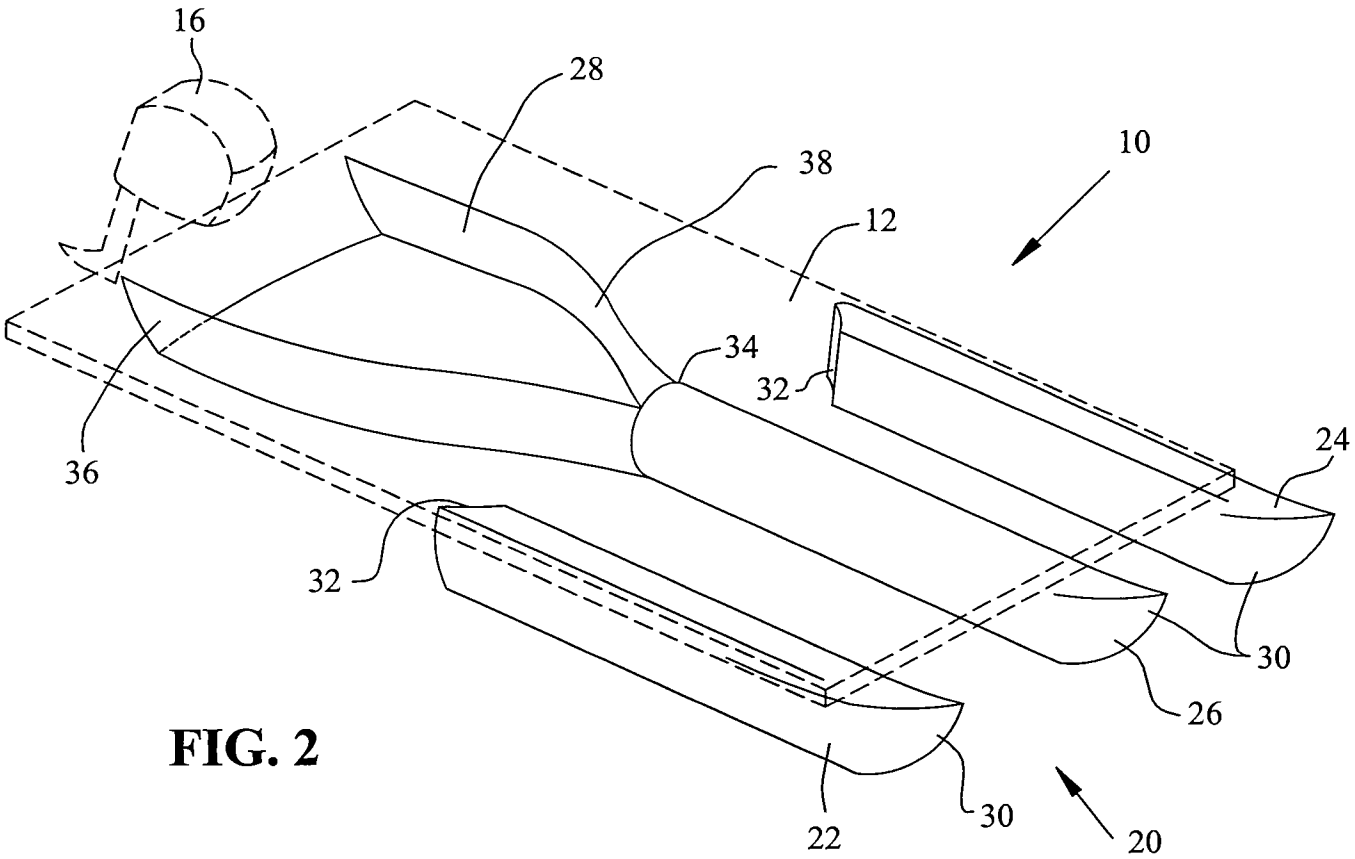
FIG. 2 is a perspective view of the hybrid running surface of the pontoon boat of FIG. 1 with the deck and equipment mounted to the deck removed, but with the deck and motor shown in phantom lines.
Figure 3:
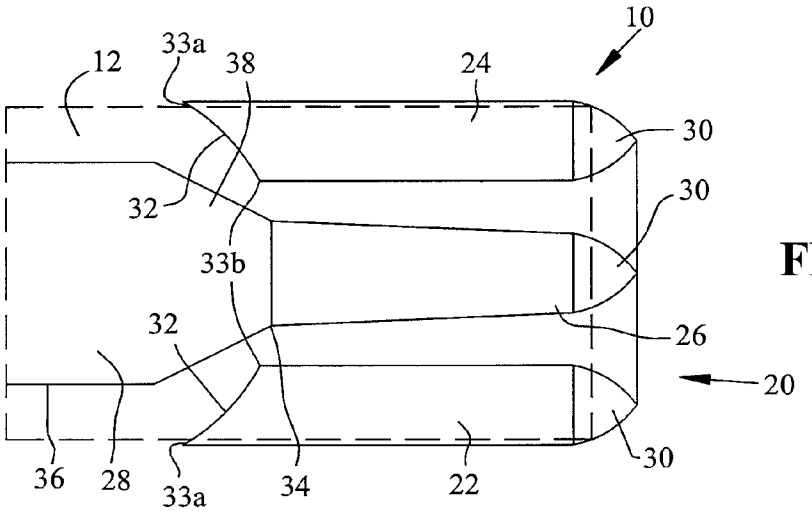
FIG. 3 is a plan view of FIG. 2.
Figure 4:
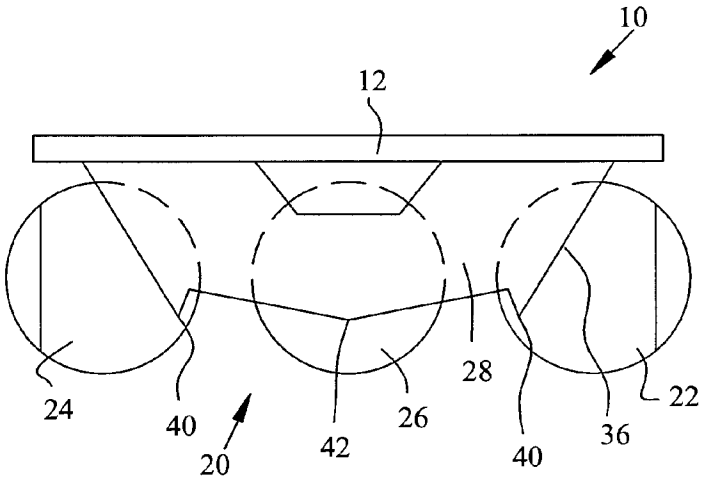
FIG. 4 is an aft view of FIG. 2.

Now referring to FIGS. 2-4, hybrid running surface 20 includes two outer pontoons, 22 and 24, and a combination middle pontoon, 26 and hull section/portion 28. In the embodiment shown, hull portion 28 is attached to and mounted to the rear of pontoon 26, which is located intermediate between outer pontoons 22 and 24. Pontoons 22, 24 and the front portion of pontoon 26 are manufactured in accordance with known methods for constructing pontoons. Furthermore, the pontoons and hull portion 28 are constructed from known suitable materials for pontoon and boat construction including, but not limited to metals such as aluminum, steel, or stainless steel; composite materials such as fiberglass, or suitable plastic polymers. In the embodiment shown, each of the pontoons 24-26 has a tapered front portion 30 for facing and cutting into the water. In addition, pontoons 22 and 24 have curved or angled aft ends 32 that extend farther backward along the outer edges 33*a* than towards the inner portions 33*b* (as best shown in FIG. 3) to accommodate hull portion 28 and facilitate water flow.

It should further be appreciated that deck 12 is mounted to pontoons 22-26 and hull 28 using conventional methods.

Combination pontoon 26 and hull portion 28 are attached to one another at a junction 34. Hull portion 28 has a varied width and in the embodiment shown, is widest towards its aft end 36 and narrowest at a front end 38 where it is attached to pontoon 26. This configuration serves a joint purpose in that it transitions via attachment at forward end 38 to pontoon 26 while maintaining a wider aft end to produce the desired wake characteristics. Furthermore, in this embodiment, hull portion 28 does not extend as far below deck 12 as pontoons 22-26 do (see FIG. 4). It should be appreciated that at juncture 34, a sharp transition in height between hull portion 28 and pontoon 26 may be made or hull portion 26 may be gradually tapered downward to meet at the same depth or distance from deck 12 as the bottom of pontoon 26 extends. It should be appreciated that the attachment of hull 28 to pontoon 26 may be made by welding or other known means.

Also, in the embodiment shown in FIG. 4, hull portion 28 has a generally V-shaped or tapered cross-section being narrower at the bottom than towards the top. In addition, hull portion 28 includes two extension portions 40 for riding and wave characteristics. The remaining bottom of hull portion 28 is tapered down to a ridge 42 extending along a midline thereof.

Figure 5:
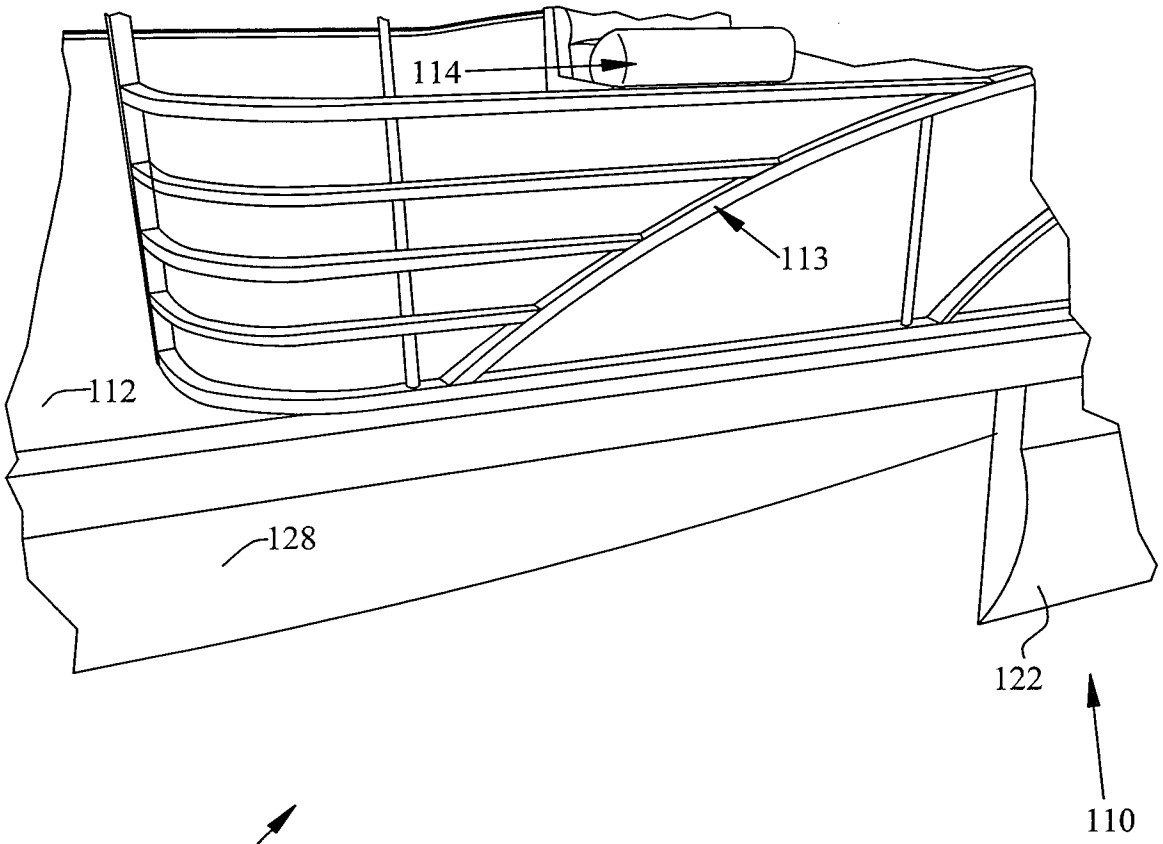
FIG. 5 is a close up perspective view of another embodiment of a pontoon boat and hybrid running surface in accordance with the subject invention.
Figure 6:
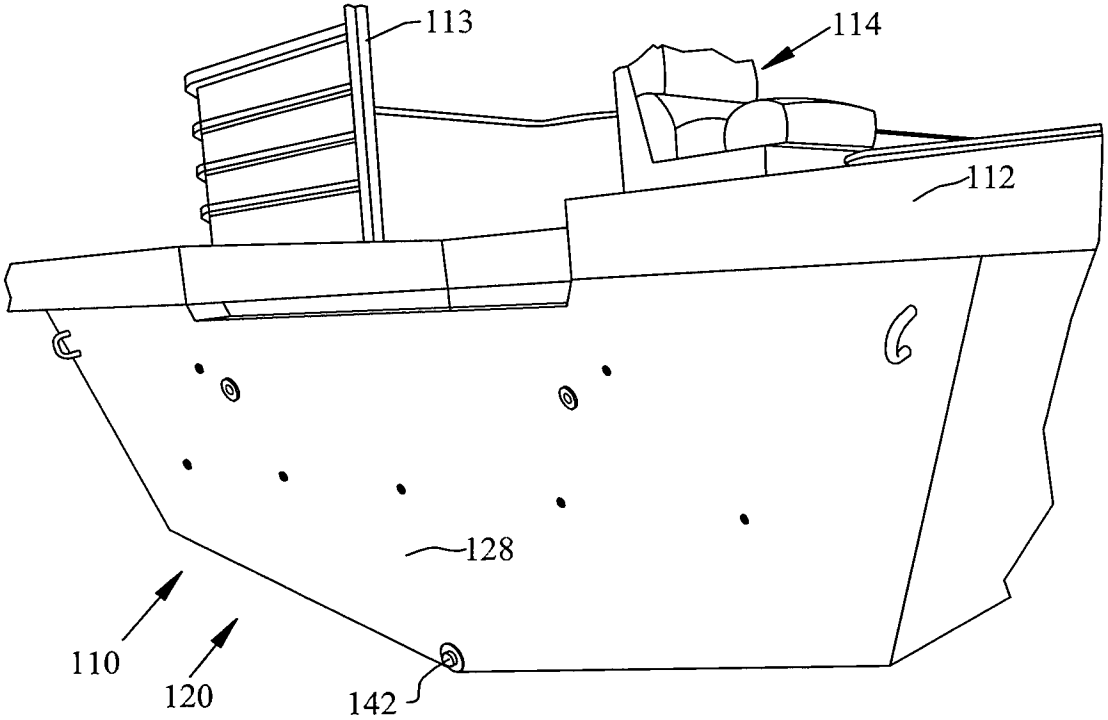
FIG. 6 is a perspective aft view of the pontoon boat of FIG. 5.

Now referring to FIGS. 5 and 6, another embodiment of a pontoon boat is shown, generally indicated as 110. Pontoon boat 110 is similar in many respects to pontoon boat 10 and includes a deck 112; a railing 113 extending around the periphery of deck 112; a seating arrangement, generally indicated as 114; and a hybrid running surface, generally indicated as 120. Pontoon boat 110 includes pontoons similar to that of pontoon boat 10, but has a modified hull portion 128. Hull portion 128 does not have extension portions along the bottom ends, but does include a middle ridge 142 extending along a midline thereof. Furthermore, the aft end of hull portion 128 may extend farther downwardly from deck 112 than pontoon 122 or any of the other pontoons (not shown).

While the invention has been taught with specific reference to these embodiments, one skilled in the art will recognize that changes can be made in form and detail without departing from the spirit and scope of the invention. For example, it is possible to have the rear part of the hull portion extend out even wider than shown so that its width equals or exceeds the width between the outer pontoons. Additionally, other changes may be made in the shape of the hull to enhance the wake characteristics. The described embodiments are to be considered, therefore, in all respects only as illustrative and not restrictive. As such, the scope of the invention is indicated by the following claims rather than by the description.

The invention claimed is:

1. A boat including:

a deck;

a plurality of pontoons extending in a direction parallel to a longitudinal axis of the deck, the deck being attached to said pontoons; and a hull portion attached to and extending from one of said pontoons, said hull portion extending outwardly to a distance wider than the pontoon to which it is attached, wherein there are three pontoons including two outward pontoons and a middle pontoon, and said hull portion is attached to said middle pontoon, and wherein rear ends of said outward pontoons are curved or angled so that outer ends of said outward pontoons extend back farther from a front of the boat than along the inner sides of said outward pontoons.

2. The boat as set forth in claim 1, wherein at least a part of the hull portion does not extend as far downwardly from said deck as said pontoons.

3. The boat as set forth in claim 2, wherein said hull portion does not extend as far downwardly from said deck as the pontoon to which it is attached in the area of attachment.

4. A boat including:

a deck;

a plurality of pontoons extending in a direction parallel to a longitudinal axis of the deck, the deck being attached to said pontoons; and a hull portion attached to and extending from one of said pontoons, said hull portion extending outwardly to a distance wider than the pontoon to which it is attached, and wherein said hull portion extends downwardly further from said deck at a rear end thereof than said pontoons.

5. A boat including:

a deck;

a plurality of pontoons extending in a direction parallel to a longitudinal axis of the deck, the deck being attached to said pontoons; and a hull portion attached to and extending from one of said pontoons, said hull portion and said pontoons having a rigid construction and manufactured from the same materials, and at least a portion of said hull extending at a different depth from said deck than said pontoon to which it is attached, wherein said hull portion extends downwardly farther from said deck at a rear end thereof than said pontoons.

6. The boat as set forth in claim 5, wherein said hull portion extends outwardly to a distance wider than the pontoon to which it is attached.

7. The boat as set forth in claim 6, wherein said hull portion extends farther rearwardly than any of said pontoons.

8. The boat as set forth in claim 5, wherein at least a portion of said hull does not extend as far downwardly from said deck as said pontoons.

9. The boat as set forth in claim 5, wherein there are three pontoons including two outward pontoons and a middle pontoon, and said hull portion is attached to said middle portion.

10. A boat including:

a deck;

a plurality of pontoons extending in a direction parallel to a longitudinal axis of the deck, the deck being attached to said pontoons, including a pair of outward pontoons having curved or angled aft ends so that outward portions of said pontoons extend back further from a front end of the boat than along inner sides of said outward pontoons; and a hull portion attached to and extending from one of said pontoons, said hull portion and said pontoons having a rigid construction and manufactured from the same materials, and at least a portion of said hull extending at a different depth from said deck than said pontoon to which it is attached.

11. A boat including:

a deck;

a plurality of pontoons extending in a direction parallel to a longitudinal axis of the deck, the deck being attached to said pontoons; and a hull portion attached to and extending from one of said pontoons, said hull portion having a varied width and being narrowest where attached to said pontoon and widest at an aft end thereof.

12. The boat as set forth in claim 11, wherein said hull portion extends farther rearwardly than any of said pontoons.

13. The boat as set forth in claim 12, wherein at least a portion of said hull extends downwardly to a different depth than said pontoon to which it is attached.

14. The boat as set forth in claim 13, wherein there are three pontoons including two outward pontoons and a middle pontoon, and said hull portion is attached to said middle pontoon.

15. The boat as set forth in claim 14, wherein rear ends of said outward pontoons are curved or angled so that the outer ends of said outward pontoons extend back further from a front of the boat than along the inner sides of said outward pontoons.

16. The boat as set forth in claim 14, wherein a rear end of said hull extends outwardly beyond at least a portion of said outward pontoons.

* * * * *